United States Patent [19]

Korhel

[11] 3,972,502

[45] Aug. 3, 1976

[54] ADJUSTABLE SIDEBOARD SUSPENSION MEANS

[75] Inventor: John S. Korhel, Vermilion, Ohio

[73] Assignee: Metallurgical Exoproducts Corporation, McKees Rocks, Pa.

[22] Filed: Jan. 30, 1975

[21] Appl. No.: 545,610

[52] U.S. Cl. ..... 249/198; 52/486; 249/202

[51] Int. Cl.[2] ..... B22D 7/10

[58] Field of Search ..... 249/197, 202, 198; 248/295; 52/486

[56] References Cited

UNITED STATES PATENTS

| | | | |
|---|---|---|---|
| 3,313,254 | 4/1967 | Birse | 52/486 X |
| 3,722,848 | 3/1973 | Young | 249/197 |
| 3,797,801 | 3/1974 | Mueller | 249/197 |

FOREIGN PATENTS OR APPLICATIONS

| | | | |
|---|---|---|---|
| 1,261,633 | 2/1968 | Germany | 249/202 |

*Primary Examiner*—Robert D. Baldwin
*Attorney, Agent, or Firm*—Webb, Burden, Robinson & Webb

[57] ABSTRACT

The adjustable suspension system for suspending the hot top sideboard in an ingot mold comprises a bent hanger rod having one end positioned within the sideboard and adapted to be frictionally slidable along its vertical axis for vertical adjustment. The hanger is held in the desired fixed position by means associated with the sideboard which lock the hanger rod in place. The rod is normally L-shaped, but it may also be double bent. The means for locking the rod in the desired position can be strips such as metal strapping rigidly fixed in the hot top board and extending outwardly therefrom to lock the hanger rod in the desired position by wrapping the strips about the rod, extending the rod through the strips in appropriately positioned holes, hooking the rod to the strips by S-shaped hooks, or the like.

7 Claims, 7 Drawing Figures

ADJUSTABLE SIDEBOARD SUSPENSION MEANS

FIELD OF THE INVENTION

My invention relates to a suspension system for hot top sideboards and, more particularly, to an adjustable suspension system for suspending disposable sideboards at a desired depth within an ingot mold.

DESCRIPTION OF THE PRIOR ART

Modern hot top systems employed in the teeming of killed steel ingots and the like are normally of the disposable type and comprise hot top sideboards suspended in the ingot mold and held in place by various clips, wedges, rods or other maintaining means.

In order for a hot top system to be effective, it must be substantially filled with molten metal to provide an adequate molten metal reservoir to fill the shrinkage cavity formed during the solidification of the ingot. This hot top volume normally varies from 10 to 15% of the total volume of the ingot mold. For a given mold size, a known and reoccurring ingot weight is obtained. However, it is often advantageous to alter the ingot weight for a given mold size to provide particular slab or bloom cuts necessary to make an ordered weight. Without this flexibility for a given mold size, usable steel is often discarded to make the necessary weight ordered by the customer. This, of course, substantially reduces the overall yield of the product and in practice it is often necessary to provide as much as 5,000 pounds of extra steel to obtain a 1,000 pound larger slab simply because there is no flexibility for a given mold size and thusly a substantially larger mold size must be used.

Steel manufacturers overcome this problem by adjusting the pour height of the ingot by adjusting the height of the hot top system within the ingot mold. In other words, where a hot top system is placed deeper into an ingot mold, the hot top volume necessary for proper solidification can still be employed, yet a smaller ingot weight is obtained by merely pouring a shorter ingot. A hot top system positioned adjacent to or slightly below the top of the ingot is known as a flush setting and steel manufacturers need the flexibility to lower the hot top systems up to six inches or so below the flush position.

Settings of hot tops below the flush position are difficult for the steel manufacturer because he must hold the disposable board manually at the desired position while installing the longer than normal clips, wedges or other maintaining systems.

SUMMARY OF THE INVENTION

My invention increases the range of ingot weights for a given mold size by providing an adjustable suspension system for suspending hot top sideboards in an ingot mold to the desired pour height. My invention provides the same ease of setting a hot top below the flush position as for the flush position.

My invention can be used with many of the known maintaining systems for tightly maintaining the hot tops in fixed position. Typical of such maintaining systems which can be used with my adjustable suspension system is that described in Kock et al. U.S. Pat. No. 3,421,731.

My suspension system includes a bent rod having a first end slidably positioned within the sideboard and a second end adapted for positioning on the ingot mold.

A hanger rod is slidable along its vertical axis and is locked in the desired position by means associated with the sideboard which cooperate with the hanger rod to achieve the fixed position relative to the ingot mold. These means include strips connected to the sideboards which can be wrapped around the hanger rod, or perforated strips or sections which accommodate the hanger rod, or S-shaped hooks which cooperate between rigid strips and the hanger rods, or the like. The hanger is contained within a sleeve member within the hot top to permit the slidable movement.

DESCRIPTION OF THE PREFERRED EMBODIMENTS

Figure 1:
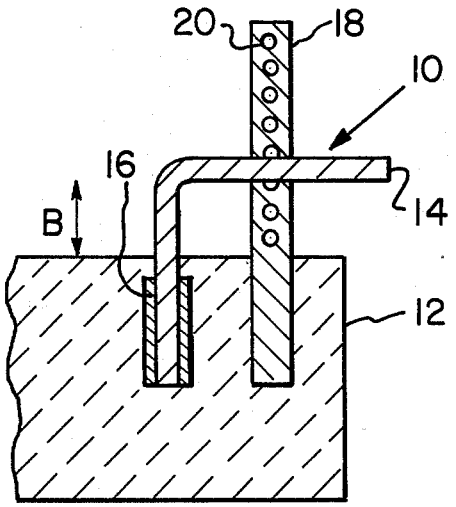
FIG. 1 is a section through the hot top and adjustable suspension system.

The adjustable suspension system, generally designated 10, is attached to hot top sideboard 12, FIG. 1. These sideboards 12 are of the disposable, preformed type and the composition thereof does not form a part of the invention. The suspension system 10 includes a hanger rod 14 and a locking member such as metal strip 18 illustrated in FIG. 1. Each sideboard 12 normally has a hanger rod and locking member at each end thereof.

Figure 2:
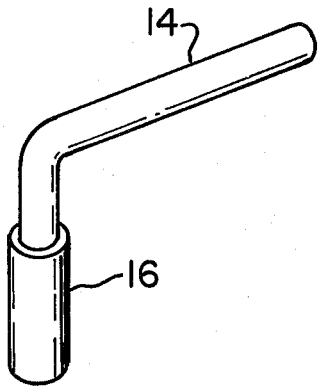
FIG. 2 is an isometric of the hanger rod and sleeve.

Hanger rod 14 is bent 90° to form an L-shaped hanger. One end of the hanger 14 is positioned in an elongated sleeve 16, FIGS. 1 and 2, and is molded into the sideboard 12 while the sideboard is being formed. For illustration purposes, the sleeve 16 in FIGS. 1 and 2 is shown substantially thicker than necessary. In practice the sleeve may merely be a thin sheet of paper or metal wrapped around the hanger rod 14. I have found that such a wrapping permits the hanger rod to frictionally slide along its vertical axis so as to be adjustable. The frictional engagement of the hanger prevents the sideboard from freely disengaging therefrom. This movement along the vertical axis for the hanger rod 14 is shown by arrow B in FIG. 1.

Since the hanger is locked in place as will be described hereinafter, it is also possible for the sleeve to be independently molded within the hot top so as to accommodate a hanger placed therein. Such an arrangement (not shown) required additional labor and will generally result in a more complex suspension system than that illustrated.

The strip 18 is also embedded within the sideboard 12 during the hot top sideboard molding operation. The strip 18 is positioned so as to extend substantially vertically upward from the sideboard 12 and substantially adjacent the free end of the hanger rod 14. Strip 18 includes a plurality of spaced indicia such as openings 20 to indicate the various height dimensions obtainable by sliding hanger rod 14 along it vertical axis.

Figure 3:
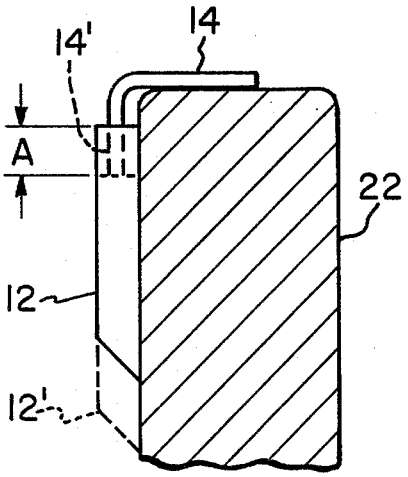
FIG. 3 is a section through an ingot mold wall showing the hot top at two different pour heights.

In FIG. 3 I have illustrated a mold wall 22 in which the sideboard 12 is suspended in a position slightly below a flush setting by hanger 14. In the same figure I have shown by dotted lined the hanger rod 14' adjusted upwardly with respect to sideboard 12' so that the sideboard is substantially below a flush position and a distance A below the position shown for sideboard 12.

Figure 4:
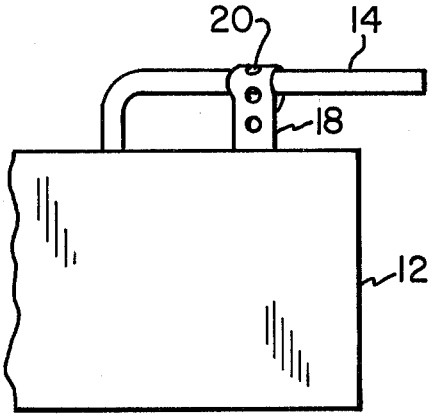
FIG. 4 is an elevation of the sideboard and suspension system.
Figure 5:
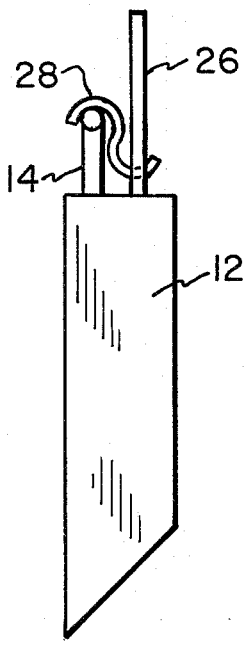
FIG. 5 is a side elevation of the suspension system including an S-shaped hook.

There are several ways of locking the hanger 14 at the desired adjustment. The strip 18 may merely be wrapped about the hanger rod 14 in the desired position as shown in FIG. 4. Where the sideboard is positioned in a flush setting, the excess strip is merely wrapped around the hanger 14 several times (not shown). The hanger can also be positioned through one of the openings 20 in the strip 18, but because this is often difficult because of the rigid securement of strip 18 to the sideboard 12, and S-shaped hook 28 can be used, FIG. 5. The hanger rod 14 is adjusted to the desired height and the S-shaped hook 28 is inserted over the rod 14 and in the proper opening 20 in the strip 26. In the locked position the hanger 14 cannot move upward because of the restraint of the S-shaped hook 28 and the sideboard 12 cannot move downward because of the restraint caused from the S-shaped hook 28 positoned in the opening 20 of strip 26 which is rigidly secured within the hot top sideboard 12.

Figure 6:
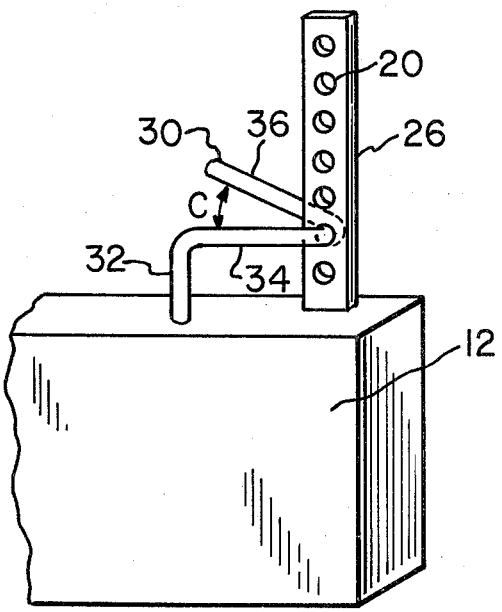
FIG. 6 is an isometric of the sideboard and suspension system including a double bent hanger rod.

The hanger rod 30 may also be double bent as illustrated in FIG. 6. Hanger rod 30 includes a first leg 32 embedded in the hot top sideboard 12 for sliding engagement therewith in a manner similar to that illustrated in FIG. 1. An intermediate leg 34 is bent perpendicular to leg 32 and extends longitudinally along the hot top sideboard 12. Leg 36 is reversely bent relative to leg 34 at an angle C, preferably 45 to 50° for ease of insertion. The locking strip 26 is secured to hot top 12 as in the previous embodiments. Strip 36 contains a plurality of openings 20 based preferably at 1 inch intervals. The hanger rod 30 is adjusted along its vertical axis to the desired height and the hanger rod 30 is then rotated so that leg 36 passes through the desired opening 20 in strip 26, FIG. 6.

Figure 7:
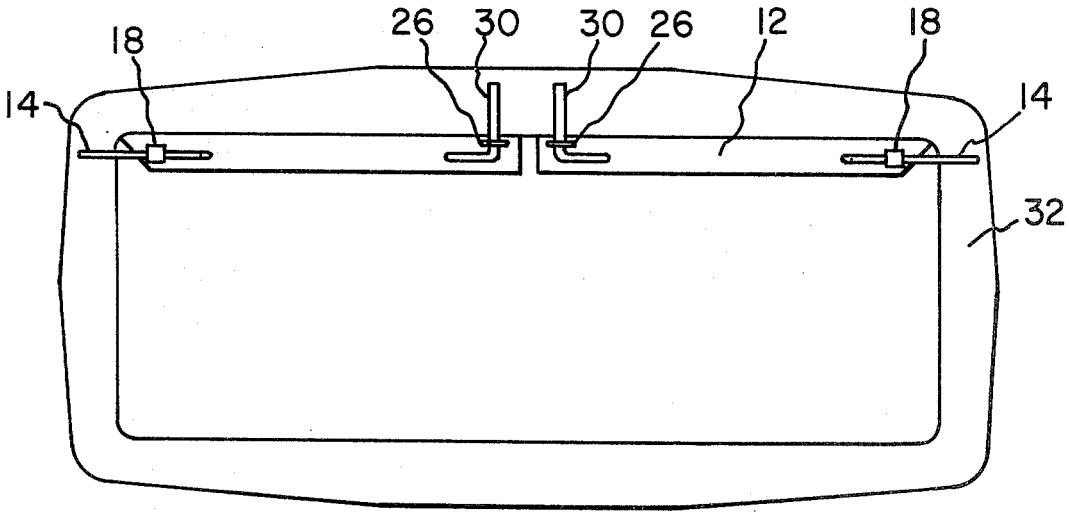
FIG. 7 is a plan view of an ingot mold showing two hot top boards employing the suspension system and in end to end relationship.

The double bent hanger rod 30 is particularly useful for sideboards which are used on extremely wide molds where the mold side walls are substantially greater than the mold end walls. In such applications two or more sideboards are often positioned in end to end relationship along the mold side walls, see FIG. 7, where two hot top sideboards 12 are so positoned. Sideboards 12 are shown along a single mold side wall, but it will be recognized that both side walls require sideboards, and depending on the mold dimensions, sideboards may also be used on the end walls.

The hanger rods 14 and strips 18 employed at the opposing end walls of the mold 32 are of the type illustrated in FIGS. 1–5, that is, L-shaped. The hanger rods 30 and strips 26 employed at the respective opposing ends of the hot tops 12 but at the center of the ingot mold 32 are of the double bent type, FIG. 6 embodiment, so that the hanger rods 30 rest on the side walls of the ingot mold 32 whereas the L-shaped hangers 14 rest on the end walls of the ingot mold 32.

In all of the above adjustable suspension system embodiments, standard maintaining systems can be employed to tightly hold the sideboards against the ingot walls after the sideboards are positioned in the ingot mold for the desired pour height setting.

I claim:

1. An adjustable suspension system integral with and for suspending a hot top sideboard in an ingot mold comprising:

A. a sleeve member positioned along a vertical axis within the sideboard;

B. a bent rod having a first end positioned within the sleeve member for frictionally slidable, vertical movement therein and a second end extending outward from the sleeve member for positioning on the ingot mold;

C. a strip rigidly secured within the hot top substantially adjacent the bent rod and extending substantially vertically from said hot top; and D. means to lock the second end of the bent rod to the strip in a fixed position relative to the sideboard.

2. The suspension system of claim 1, said means including a wrapped connection locking the rod to the strip.

3. The suspension system of claim 1, said strip being rigid and including a plurality of openings spaced along a vertical axis and adapted to accommodate the second end so as to form the means to lock the rod to the strip.

4. The suspension system of claim 1, said strip being rigid and including a plurality of openings spaced along a vertical axis, said means comprising an S-shaped hook adapted to engage the second end of the rod and one of said spaced openings to lock the rod to the strip.

5. The suspension system of claim 1, said bent rod including a first leg within the board, a second leg substantially perpendicular to the first leg and a third leg angled to the second leg and adapted for positioning on the ingot mold, said strip being rigid and including a plurality of openings spaced along a vertical axis and adapted to accommodate at least one of the second and third legs.

6. The suspension system of claim 5, wherein said second and third leg form an angle of about 45° to 50° therebetween.

7. An adjustable suspension system integral with and for suspending a hot top sideboard in an ingot mold comprising:

A. first and second sleeve members positioned along a vertical axis within the sideboard with one said sleeve member near each end thereof;

B. an L-shaped rod having a first end positioned within the first sleeve member for frictionally slidable, vertical movement therein and a second end extending outward from the first sleeve member for positioning on the ingot mold;

C. a double bent rod having a first leg positioned within the second sleeve member for frictional slidable vertical movement therein, a second leg substantially perpendicular to the first leg and extending along a longitudinal axis of the sideboard and a third leg angularly extending from the second leg for positioning on the ingot mold;

D. first and second strips rigidly secured within the sideboard with one said strip substantially adjacent each rod and extending substantially vertically from said sideboard; and E. means to lock the second end of the L-shaped rod and means to lock at least one of the second and third legs of the double bent rod to the respective first and second strips in a fixed position relative to the sideboard.

* * * * *